United States Patent [19]

Sauer

[11] Patent Number: 4,717,080

[45] Date of Patent: Jan. 5, 1988

[54] ELECTROMAGNETICALLY ACTUATABLE FUEL INJECTION VALVE

[75] Inventor: Rudolf Sauer, Benningen, Fed. Rep. of Germany

[73] Assignee: Robert Bosch GmbH, Stuttgart, Fed. Rep. of Germany

[21] Appl. No.: 783,495

[22] Filed: Oct. 3, 1985

[30] Foreign Application Priority Data

Jan. 25, 1985 [DE] Fed. Rep. of Germany ..... 3502410

[51] Int. Cl.[4] ..... F02M 51/06

[52] U.S. Cl. ..... 239/585; 239/125

[58] Field of Search ..... 239/585, 112, 113, 125; 251/129.21, 129.22

[56] References Cited

U.S. PATENT DOCUMENTS

| | | | |
|---|---|---|---|
| 3,241,768 | 3/1966 | Croft | 239/585 X |
| 3,589,610 | 6/1971 | Wahlin | 239/125 |
| 4,179,069 | 12/1979 | Knapp et al. | 239/585 X |
| 4,365,746 | 12/1982 | Tanasawa et al. | 239/125 |
| 4,395,988 | 8/1983 | Knapp et al. | 239/125 X |
| 4,483,484 | 11/1984 | Hafner et al. | 239/585 |

*Primary Examiner*—Andres Kashnikow

*Attorney, Agent, or Firm*—Edwin E. Greigg

[57] ABSTRACT

An electromagnetically actuatable fuel injection valve for fuel injection systems is proposed. The valve includes a valve housing and a first connection pipe serving as the core, which is surrounded by a magnetic coil. A second connection pipe is disposed inside the first connection pipe and with it forms a flow cross section for the inflowing fuel, which via the flow conduit can flow into an interior chamber of the valve housing surrounding the magnetic coil and from there can flow via a connecting line into a fuel chamber surrounding a nozzle needle, this chamber being defined by a guide bore in the nozzle body as well as by an injection port at one end and by an armature on the other. A bypass bore is provided in a head of the nozzle needle leading from this fuel chamber to an inner bore of the armature. This inner bore is open toward the second connection pipe so that at least a partial quantity of fuel is capable of flowing back via the second connection pipe.

6 Claims, 2 Drawing Figures

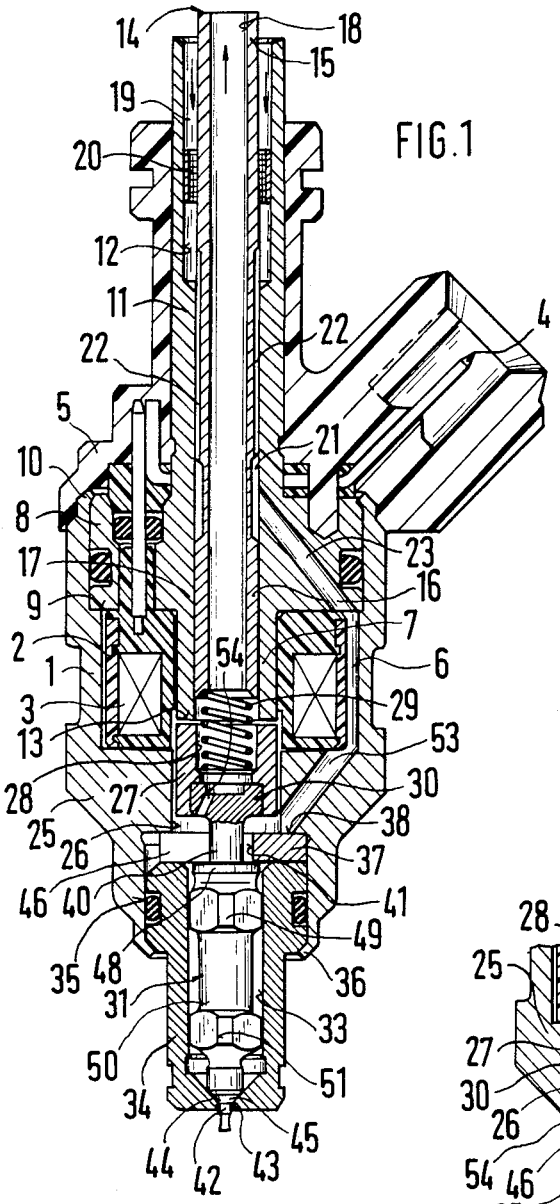
FIG.1
FIG.2
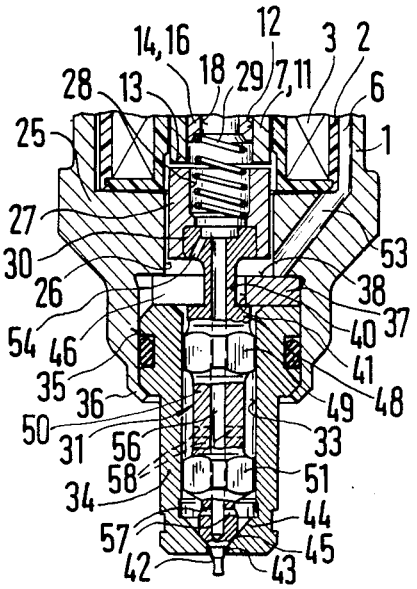

ELECTROMAGNETICALLY ACTUATABLE FUEL INJECTION VALVE

BACKGROUND OF THE INVENTION

The invention is based on an electromagnetically actuatable fuel injection valve as generically defined hereinafter. In such fuel injection valves, the intent is to cool them by passing fuel around the magnetic coil, and in flushing the fuel injection valve to carry any vapor bubbles that are present away into a return line. For instance, if vapor bubbles happen to be injected through a fuel injection valve, the result is not only problems when starting the engine, but also rough engine operation or even engine stalling. A fuel injection valve is already known in which part of the fuel passed around the magnetic coil can already flow back into the return line from above the armature; the result is that direct cooling, of the valve closing member as well, takes place only to a limited extent.

OBJECT AND SUMMARY OF THE INVENTION

The fuel injection valve according to the invention has the advantage over the prior art that all the fuel delivered to the fuel injection valve initially is guided to the side of the armature remote from the and thus it is fully available for cooling the valve closing member as well, before at least a partial fuel quantity can flow back to the return line.

A particularly advantageous feature of the invention provides for guiding the returning fuel quantity through a flow connection with the nozzle needle, which in particular terminates as close as possible to the nozzle needle in the vicinity of the valve seat. As a result, a direct and intensive cooling of the nozzle needle is assured as well.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 shows a cross sectional view of a fuel injection valve embodied according to the invention; and FIG. 2 is a fragmentary cross sectional view of a fuel injection valve embodied according to the invention, having a blind bore in the nozzle needle.

DESCRIPTION OF THE PREFERRED EMBODIMENTS

The fuel injection valve shown in FIG. 1 for a fuel injection system of a mixture-compressing internal combustion engine having externally supplied ignition has a valve housing 1 of ferromagnetic material, in which a magnetic coil 3 is diposed on a coil carrier 2. The magnetic coil 3 has a plug connection 4, which is embedded in a plastic ring 5 that partially encompasses the upper portion of the valve housing 1. The coil carrier 2 of the magnetic coil 3 is seated in an interior chamber 6 of the valve housing 1 on a core 7, which protrudes partway into the interior 6 and with a flange 8 closes off the interior 5 with respect to the plastic ring 5. The flange 8 is seated at one end on a step 9 of the valve housing and on the other end is partially gripped circumferentially by a crimped portion 10 of the valve housing, which presses the flange 8 against the step 9. The first connection pipe 11 has a stepped bore 12, which extends concentrically with respect to the longitudinal axis of the valve and reaches as far as the end face 13 of the core 7. A further connection pipe 14 is inserted into the stepped bore 12 in such a way that with its end 15 remote from the core, it protrudes out of the first connection pipe 11 and with its opposite bearing end 16 is sealingly pressed into the section 17 of the stepped bore 12 that is embodied with a smaller diameter. The second connection pipe 14 has a return flow bore 18, extending in the axial direction, which communicates via a plug nipple, not shown, with a return line leading to the intake side of a fuel feed pump. Between the first connection pipe 11 and the second connection pipe 14, an annular flow cross section 19 is formed, by way of which the fuel pumped by a fuel feed pump and delivered via a plug nipple flows into the fuel injection valve in the direction of the arrow. A fuel filter 20 may be disposed in the flow cross section 19. The flow cross section 19 may, in a manner not shown, extend as far as the bearing end 16 of the second connection pipe 14. In the manner shown, the flow cross section 19 can end before the bearing end 16 of the second connection pipe 14, and at the bearing end 16 an annular groove 21 is provided on the second connection pipe 14, either intersecting axially with the flow cross section 19 (not shown) or leading to the axially extending longitudinal grooves 22 of the second connection pipe 14, which begin at the flow cross section 19. Beginning at the annular groove 21, a flow conduit 23 leads through the flange 8 to the interior 6 of the valve housing 1, so that inflowing fuel flows around the coil carrier 2 of the magnetic coil 3 in the gap between the coil carrier 2 and the wall of the interior 6.

Remote from the flange 8, the interior 6 is defined by a magnetic flux conducting step 25 by the valve housing 1, which extends radially inward and has a through bore 26 in alignment with the core 7. The coil carrier 2 is seated on the magnetic flux conducting step 25. Pointing toward the core 7, an annular cylindrical armature 27 protrudes with little play into the through bore 26 of the magnetic flux conducting step 25. The armature has an inner bore 28, in which a compression spring 29 is supported, and at its other end the spring rests on the bearing end 16 of the second connection pipe 14. Remote from the core 7, a head 30 of a nozzle needle 31 protrudes into the inner bore 28 of the armature 27 and is thereby connected to the armature 27. The nozzle needle 31 extends, remote from the armature 27, into a guide bore 33 of a nozzle body 34, which is partially inserted into a retaining bore 35 of the valve housing 1 and is pressed by a crimped portion 36 upwardly against a stop plate 37, which rests on an inner shoulder 38 of the valve housing 1 that is formed by the magnetic flux conducting step 25. With a constricted section 40, the nozzle needle 31 arrives at a through opening 41 in the stop plate 37 and at a lower end of the nozzle needle a needle tang 42 protrudes from an injection port 43 of the nozzle body 34. A conical valve seat face 44 which cooperates with a conical sealing section 45 on the nozzle needle 31 is formed between the guide opening 33 of the nozzle body 34 and the injection opening 43. Between the through opening 41 and the circumference of the stop plate 37, a recess 46 is provided, the inside diameter of which is larger than the diameter of the constricted section 40 of the nozzle needle 31. The constricted section 40 is adjoined by a stop shoulder 48 of the nozzle needle 31, with which the nozzle needle rests on the stop plate 37, when the armature 27 is attracted in the excited state of the magnetic coil. Also, in the excited state the sealing section 45 will then have been raised from the valve seat 44, and fuel can now be injected via the injection port 43. The stop shoulder 48 is adjoined by a first guide section 49 of the nozzle needle 31, which is adjoined by a cylindrical section 50 and a second guide section 51. The guide sections 49 and 51 lend guidance to the nozzle needle 31 in the guide bore 33 and are embodied in a manner that is well known so as to assure a flow around the nozzle needle 31 as far as the sealing section 45.

At least one connecting line 53 leads from the interior 6 of the valve housing 1 to the fuel chamber, which is formed between the armature 27 and the valve seat 44, surrounding the nozzle needle 31. The connecting line 53 is embodied in the magnetic flux conducting step 25 and discharges between the armature 27 and the stop plate 37. A bypass bore 54 provided in the head 30 of the nozzle needle 31 connects the inner bore 28 of the armature 27, and thus the second fuel pipe 14, to the fuel chamber between the head 30 and the stop shoulder 48 of the nozzle needle 31 and enables a return flow of fuel to the fuel return line and a flushing out of undesirable vapor bubbles. The bypass bore 54 thus represents a flow connection from the fuel chamber, located between the armature 27 and the injection port 43, to the second connection pipe 14.

In a further exemplary embodiment of a fuel injection valve as shown in FIG. 2, in which elements remaining the same as and having the same function as those in the fuel injection valve shown in FIG. 1 retain the same reference numerals, the nozzle needle 31 has a blind bore 56 that is open toward the inner bore 28 of the armature 27 and extends in the direction of the longitudinal axis of the valve, for instance almost to the needle tang 42. Transverse bores 57, for instance two in number, begin at the blind bore 56 and end in the fuel chamber between the second guide section 51 and the valve seat 44, preferably near the valve seat 44. In another embodiment, indicated by dashed lines in FIG. 2, transverse bores 58, instead of the transverse bores 57, begin at the blind bore 56 and end in the fuel chamber between the first guide section 49 and the second guide section 51 of the nozzle needle 31. The blind bore 56, together with the transverse bores 57 or 58, again represents a flow connection between the fuel chamber and the second connection pipe 14, bypassing the nozzle needle 31. The flow connections represented by the bypass bore 54 and the blind bore 56 together with the transverse bores 57 or 58 can both be provided at once, in which case the returning partial fuel quantities can be selectively influenced by the selection of the cross section of the bypass bore 54 and of the transverse bores 57 or 58.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. An electromagnetically actuatable fuel injection valve for fuel injection systems of internal combustion engines, comprising a valve housing (1) having a longitudinal axis and a step (25), a magnetic coil (3) in an interior (6) of said valve housing, said magnetic coil arranged to surround a core (7) of ferromagnetic material, a valve needle (31), a cylindrical armature (27) in proximity to said core adapted to actuate said valve needle counter to the force of a compression spring (29), said valve needle arranged to cooperate with a fixed valve seat (43); first and second coaxial pipe means (11,14) disposed relative to said longitudinal axis, said first and second pipe means adapted to permit an inlet fuel flow and a return fuel flow, said armature comprising an annular body and a bore (28) and includes an end remote from said core which protrudes with little play into a through bore (26) of said step in said housing, said armature further adapted to extend below said magnetic coil adjacent to a fuel chamber (46), a nozzle body (34), a guide bore (33) in said nozzle body, said valve needle extending in said guide bore and having a terminus (30) affixed to said armature and provided with a flow connection (54), said flow connection in said valve needle terminus being in communication with said fuel chamber and said second pipe means, and said first pipe means being adapted to supply fuel through said housing and around said magnetic coil to said valve needle via a connecting line (53) which is embodied in said valve housing (1) and which discharges downstream of said armature (27) and communicates with said interior (6) which receives said magnetic coil.

2. A fuel injection valve as defined by claim 1, in which said valve needle includes a first guide section and a bypass bore which communicates with said return fuel flow pipe means and said fuel chamber, said fuel chamber disposed between said armature and said first guide section of said valve needle.

3. A fuel injection valve as defined by claim 2, in which said valve needle includes a blind bore that opens toward said bore in said armature, said blind bore in said valve needle adapted to communicate via at least one transverse bore with a second fuel chamber near the valve seat in proximity to said terminus of said valve needle.

4. A fuel injection valve as defined by claim 1, in which said valve needle includes a blind bore (56) that opens toward said bore (28) in said armature, said blind bore in said valve needle adapted to communicate via at least one transverse bore (57) with a second fuel chamber near the valve seat in proximity to said terminus of said valve needle.

5. A fuel injection valve as defined by claim 1, in which fuel enters said valve housing through a passageway disposed interiorly of said inlet fuel flow pipe means and exits through said return fuel flow pipe means.

6. An electromagnetically actuatable fuel injection valve for fuel injection systems of internal combustion engines, comprising a valve housing having a longitudinal axis and a step, a nozzle body secured to said housing, a guide bore in said nozzle body and a fixed valve seat, a magnetic coil in an interior of said valve housing, said magnetic coil arranged to surround a core of ferromagnetic material, a cylindrical armature in proximity to said core, first and second coaxial pipe means disposed relative to said longitudinal axis, said first and second pipe means adapted to permit an inlet fuel flow and a return fuel flow, said armature comprising an annular body and a bore communicating with said second pipe means and includes an end remote from said core which protrudes with little play into a through bore of said step in said housing, said armature further adapted to extend below said magnetic coil adjacent to a fuel chamber and adapted to actuate a valve closing member in said nozzle body counter to the force of a compression spring, said valve closing member arranged to cooperate with said fixed valve seat; said valve closing member including a nozzle needle in said guide bore; said nozzle needle having a terminus affixed to said armature; a blind bore in said nozzle needle, said blind bore being open toward said bore in said armature; said nozzle needle including first and second guide sections; said fuel chamber being disposed between said armature and said first guide section on said nozzle needle; said terminus provided with a flow passage communicating with said fuel chamber and said second pipe means, said first pipe means being adapted to supply fuel through said housing and around said magnetic coil to said nozzle needle via a connection line (53) which is embodied in said valve housing (1) and which discharges into said fuel chamber downstream of said armature (27) and communicates with said interior (6) which receives said magnetic coil, a second fuel chamber positioned between said first and second guide sections, and one transverse bore in said nozzle needle which allows communication between said second fuel chamber and said blind bore.

* * * * *